US008376294B2

(12) United States Patent
Steury et al.

(10) Patent No.: US 8,376,294 B2
(45) Date of Patent: Feb. 19, 2013

(54) TIRE SWING SWIVEL

(75) Inventors: J. Stephen Steury, Rogersville, MO (US); Steven B. Adkins, Joplin, MO (US)

(73) Assignee: Miracle Recreation Equipment Company, Monett, MO (US)

( * ) Notice: Subject to any disclaimer, the term of this patent is extended or adjusted under 35 U.S.C. 154(b) by 103 days.

(21) Appl. No.: 12/497,062

(22) Filed: Jul. 2, 2009

(65) Prior Publication Data

US 2010/0006724 A1 Jan. 14, 2010

Related U.S. Application Data

(60) Provisional application No. 61/080,109, filed on Jul. 11, 2008.

(51) Int. Cl.
*F16M 11/00* (2006.01)

(52) U.S. Cl. ..... 248/202.1; 403/313; 403/309; 403/310; 472/118; 248/62; 248/63; 248/317; 248/339

(58) Field of Classification Search ..... 248/324, 248/340, 341, 214, 457, 59, 63, 62, 317, 248/339, 202.1, 215, 276.1, 278.1, 284.1, 248/145; 403/313, 305, 309, 310, 312.3; 472/118–125

See application file for complete search history.

(56) References Cited

U.S. PATENT DOCUMENTS 2,548,089 A * 4/1951 Wycosky ..... 482/87
2,956,768 A * 10/1960 Livingston ..... 248/324
3,362,671 A * 1/1968 Johnson ..... 248/324
4,506,317 A * 3/1985 Duddy ..... 362/396
4,836,485 A * 6/1989 Cooper ..... 248/278.1
4,872,630 A * 10/1989 Cooper ..... 248/278.1
5,286,130 A * 2/1994 Mueller ..... 403/79
6,830,517 B1 * 12/2004 Ciraolo ..... 472/118
7,461,827 B2 * 12/2008 Rivers et al. ..... 248/317
7,641,162 B2 * 1/2010 Tsay ..... 248/284.1
7,780,134 B2 * 8/2010 Panasik et al. ..... 248/324
7,837,569 B2 * 11/2010 Ouellet ..... 472/118
2006/0131467 A1 * 6/2006 Wang ..... 248/276.1
2009/0105002 A1 * 4/2009 Kahn et al. ..... 472/118

OTHER PUBLICATIONS

Miracle Recreation Equipment Company—"Fun Things for Kids"—p. 100 from the 1998 Park & Playground Equipment Catalog.
Miracle Recreation Equipment Company—Web page notice—May 20, 2008—4 pages.
Landscape Structures—Tire Swing Hanger—Web page—Jul. 1, 2008—2 pages.

* cited by examiner

*Primary Examiner* — Nkeisha Smith
(74) *Attorney, Agent, or Firm* — Polster, Lieder, Woodruff & Lucchesi, L.C.

(57) ABSTRACT

A swivel assembly for a tire comprises a clamp assembly adapted to be secured to a header tube, a swivel first member suspended from the clamp to pivot either parallel to or perpendicular to a longitudinal axis of the header tube, a swivel second member which is suspended from the swivel first member to pivot 90° relative to the pivotal motion of the swivel first member, and a swivel third member which can rotate about the swivel second member. The swivel first member is pivotally mounted to the clamp via an upper pivot pin and the second swivel member is pivotally mounted to the swivel first member by a second lower pivot pin. Lastly, the swivel assembly can include a tether which extends over the header tube to which the clamp assembly is secured which has opposite ends secured to opposite sides of the lower pivot pin.

16 Claims, 5 Drawing Sheets

TIRE SWING SWIVEL

CROSS-REFERENCE TO RELATED APPLICATIONS

This application claims priority to U.S. Provisional App. No. 61/080,109 filed Jul. 11, 2008 and which is incorporated herein by reference.

STATEMENT REGARDING FEDERALLY SPONSORED RESEARCH OR DEVELOPMENT

Not Applicable.

BACKGROUND OF THE INVENTION

This application relates to tire swings, and more particularly to the swivel which suspends the tire swing from an overhead bar.

Tire swings are commonly found in playgrounds (such as community or park playgrounds, school playgrounds, etc.). Tire swings, as is known, comprise a tire which is suspended below a header tube by a swivel assembly to be generally horizontal when stationary. The swivel assembly allows the tire to swing both parallel and perpendicular to the axis of the header bar and to rotate about an axis of the swivel assembly.

BRIEF SUMMARY OF THE INVENTION

Briefly stated, a swivel assembly for a tire swing comprises a mount, such as a clamp assembly, adapted to be secured to a header tube, a swivel first member suspended from the clamp to pivot either parallel to or perpendicular to a longitudinal axis of the header tube, a swivel second member which is suspended from the swivel first member to pivot 90° relative to the pivotal motion of the swivel first member, and a swivel third member which can rotate about the swivel second member.

The clamp assembly comprises a clamp bottom member or portion, a platform on the clamp bottom member, and a pair of spaced apart lugs extending downwardly from platform. The lugs define aligned openings.

The swivel first member comprises a body having front and back surfaces; side surfaces, a bottom surface and a pair of spaced-apart lugs extending downwardly from the bottom surface. The bottom surface comprises a central surface which is generally perpendicular to an axis of the swivel first member and sloped side surfaces. The sloped surfaces of the swivel first member bottom surface define an angle of about 45° relative to the axis of the swivel first member. The body has a side-to-side width sized to be received between the clamp assembly lugs. The body includes means for pivotally suspending the body from the mount, and hence from the header tube. Illustratively, the means for pivotably suspending the body from the mount can include an opening into the opposite sides of the body. This opening can be a through-hole or bore extending through the body. In either case a pin extends from the lugs of the clamp into the opening from either side of the body. The pin can extend through the holes in the lugs of the clamp body. In an alternative, the means can include a pin which extends from the swivel first member body which engage the lugs of the clamp. The lugs of the swivel first member can include aligned openings. An imaginary line extending through these openings is perpendicular to the longitudinal axis of the through-hole of the swivel first member.

An upper or first pivot pin extends through the through-hole of the swivel first member and the openings of the clamp lugs to pivotally connect the swivel first member to the clamp assembly. The upper pivot pin defines a pivot axis about which the swivel first member can pivot in a direction either parallel to or perpendicular to an axis of the header bar.

The swivel second member comprises a body having an upper portion and a lower portion, a flange extending outwardly proximate a bottom of the lower portion; and a through-hole extending through the upper portion. At least the lower portion is generally circular in cross-section.

A lower or second pivot pin extends through the through hole of the swivel second member and the openings of the ears of the swivel first member to pivotally connect the swivel second member to the swivel first member; whereby the swivel second member can pivot the other of parallel to or perpendicular to an axis of the header bar.

The sloped side surfaces of the bottom of the swivel first member define a positive stop to prevent the swivel second member from pivoting beyond a desired angle relative to an axis of the swivel first member. For example, the stop can prevent the swivel second member from pivoting beyond an angle of about 50° relative to the axis of the swivel first member.

The upper and lower pivot pins have a center-to-center spacing of less than about 3", and preferably about 2". Further, the lower pivot pin can have a diameter that is less than a diameter of the upper pivot pin Lastly, the swivel assembly can include a tether having opposite ends secured to opposite sides of the lower pivot pin. The tether is sized to extend over the header tube and is sufficiently strong to support the weight of the tire swing, the swivel assembly, and anyone on the tire swing should the swivel assembly catastrophically fail.

BRIEF DESCRIPTION OF THE SEVERAL VIEWS OF THE DRAWINGS

FIG. 1 was drawn in this manner for purposes of clarity.

Corresponding reference numerals will be used throughout the several figures of the drawings.

DETAILED DESCRIPTION OF THE INVENTION

Figure 1:
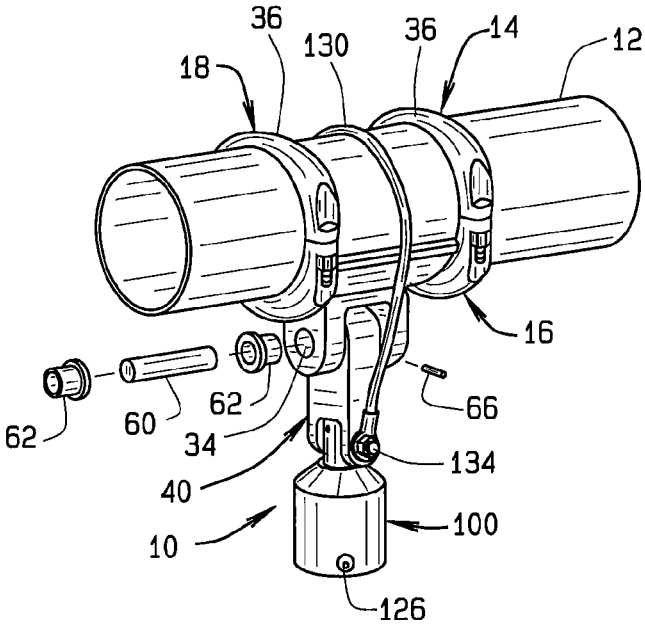
FIG. 1 is a partially exploded side perspective view of a tire swing swivel assembly made in accordance with the claims, showing the swivel assembly mounted to a header tube. It will be apparent that the explosion sequence is not correct with regard to the pin 60 and bushings 62.

The following detailed description illustrates the invention by way of example and not by way of limitation. This description will clearly enable one skilled in the art to make and use the invention, and describes several embodiments, adaptations, variations, alternatives and uses of the invention, including what we presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

An illustrative embodiment of a swivel assembly 10 is shown in FIG. 1 suspended from a header tube 12 of a play structure by means of a mounting clamp 14. The mounting clamp 14 comprises a clamp bottom portion 16 and a clamp top portion 18. The clamp bottom portion 16 (shown in more detail in FIGS. 5-8) comprises a body 20 having an inner surface 22*a*, an outer surface 22*b*, and an upper edge 22*c*. The inner surface 22*a* corresponds in size and shape to the size and shape of the header tube 12. Most header tubes are cylindrical; hence, the inner surface 22*a* of the clamp bottom portion defines an arc having a radius corresponding to the radius of the header tube 12. Flanges 24 are formed at opposite ends of the body 20. The flanges 24 have upper surfaces 24*a* which are circumferentially spaced from the upper edge 22*c* of the body 22. The inner surface of the flange is a continuation of the body inner surface 22*a*. In the illustrative embodiment, the flange inner surface defines an arc of about 180° and the body inner surface 22 defines an arc of less than 180° For example, the body inner surface 22*a* can define an arc of about 150° to about 160° . Bolt holes 26 extend downwardly from the flange upper surfaces 24*a*. In the illustrative embodiment shown, the outer surfaces of the flanges are generally curved, and flats 28 are formed on the flanges beneath the bolt holes to define an area into which the bolt holes open. A platform 30 is formed on the bottom of the clamp outer surface 22*b*; and a pair of opposed lugs 32 extend downwardly from opposite ends of the platform 30. The lugs 32 face each other and have axially aligned openings 34 which extend through the lugs.

The clamp top portion 18 is shown to comprise two half rings 36 which are sized to extend over the top of the header tube 12. The ring halves 36 each include bolt holes which align with the bolt holes 26 of the clamp bottom portion 16. Bolts are passed through the aligned holes in the two clamp portions 16, 18 to secure the clamp portions together. In the illustrative embodiment shown, nuts are used in conjunction with the bolts to secure the two clamp portions together. However, the bolt holes of, for example, the clamp bottom portion 16 could be threaded, and the bolts could be screwed into the bolt holes of the clamp bottom portion. Although clamp top portion 18 is shown as two pieces, it could be formed as a single piece. As can be appreciated, the clamp portions 16 and 18, in combination, define an inner surface shaped complementarily to the surface of the header tube to fit tightly around the header tube 12. In this manner, slippage of the clamp along the header tube 12 can be minimized. Friction enhancing features can be added to the inner surfaces of the clamp portions to further minimize the possibility of slippage along the header tube 12. Such features could include roughening the inner surfaces of the clamp portions or using a sleeve made from a high friction material between the clamp 14 and the header tube 12.

Figure 9:
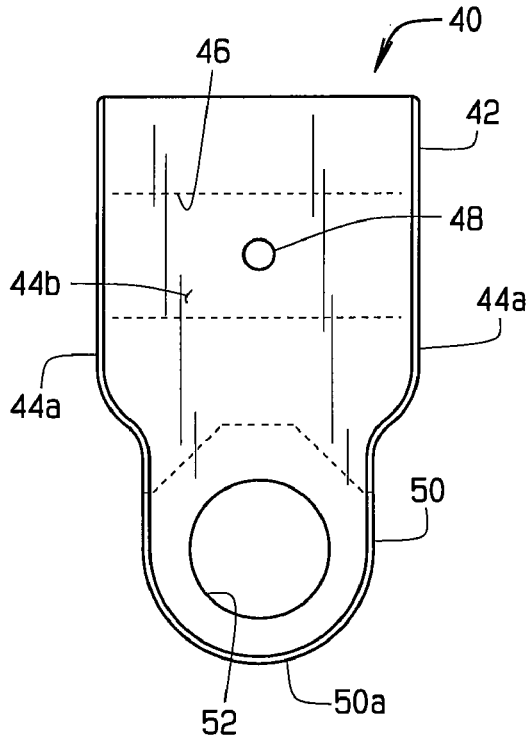
FIG. 9 is a front elevational view of a swivel first member of the swivel assembly which is suspended from the clamp bottom portion to pivot with respect to the clamp.
Figure 10:
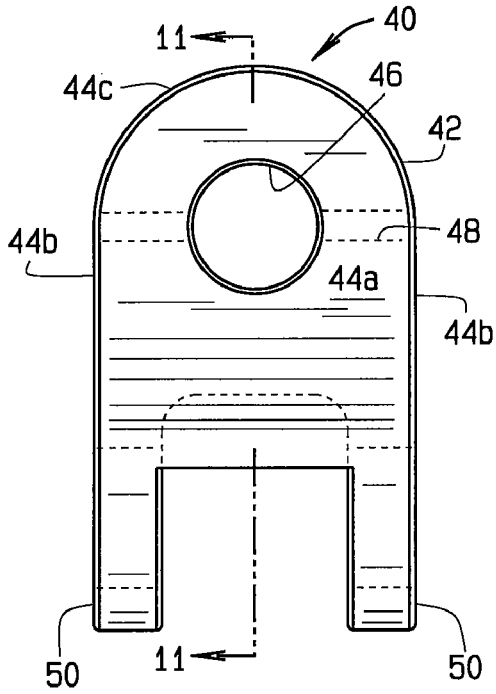
FIG. 10 is a side elevational view of the swivel first member.
Figure 11:
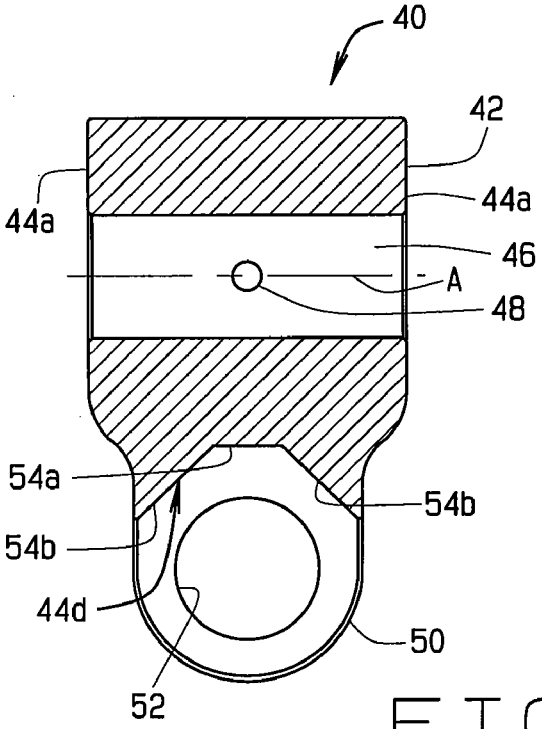
FIG. 11 is a cross-sectional view of the swivel first member taken along line 11-11 of FIG. 10.

The swivel assembly 10, as noted above, is suspended from the clamp 14 to allow a tire swing (not shown) to swing both parallel to and perpendicular to the header bar 12 and to rotate about an axis of the swivel assembly. To accomplish this, the swivel assembly 10 comprises a bracket or swivel first member 40 which is suspended from the clamp bottom portion 16. The swivel first member 40 (FIGS. 9-11) comprises a body 42. The body 42 has flat sides 44*a*, front and back walls 44*b*, a curved upper surface 44*c*, and a lower surface 44*d*. The front and back walls 44*b* transition smoothly to the curved upper surface 44*c*. The bottom surface, as best seen in FIG. 11 includes a central flat portion 54*a* and opposite sloped portions 54*b* which slope away from each other. The sloped portions 54*b*, as shown, define an angle of about 45° from the vertical. The body is sized to have a side-to-side width which will fit between the opposed lugs 32 of the clamp bottom portion 16. For example, for a clamp having a distance of about 2⅝" (about 6.7 cm) between the inner surfaces of the lugs 32, the swivel first member body 42 can have a side-to-side width of about 2¼" (about 5.7 cm). A through-hole 46 extends through the body 42 to open on the opposite sides 44*a* of the body. A pin hole 48 extends through the body 42 from front to back perpendicularly to the through-hole 46. Preferably, the pin hole 48 crosses the through-hole at an axis A of the through-hole, as seen in FIG. 11. The body side walls 44*a* curve inwardly at the bottom of the body 42 as seen in FIGS. 9 and 11, and a pair of opposed ears 50 extend downwardly from the body on opposite sides of the bottom surface 44*d*. Thus, the bottom surface 44*d* defines a channel between the ears 50. The ears 50 face each other and have aligned openings 52. An imaginary line extending through the aligned openings 52 is perpendicular to a longitudinal axis of the through-hole 46. In the illustrative embodiment, the ears have curved bottom edges 50*a*.

Figure 2:
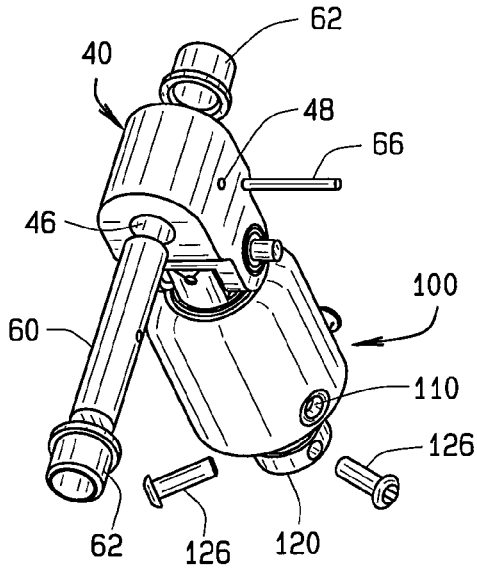
FIG. 2 is a partially exploded top perspective view of the swivel assembly.
Figure 17:
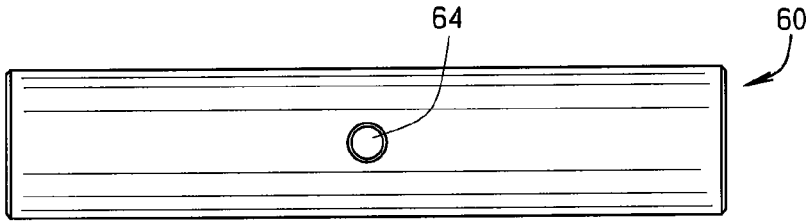
FIG. 17 is a side elevational view of a top swivel pin.

An upper pivot pin 60 (FIGS. 1 and 17) extends through the clamp lugs 32 and the swivel first member through-hole 46 to pivotally connect the swivel first member 40 to the clamp 14. To maintain the pivot pin 60 in the through-hole 46, the pivot pin has a bore 64 which aligns with the pin hole 48 in the swivel first member through-hole 46. A retaining pin 66 (FIG. 2) extends through the swivel first member body pin hole 48 and into the pivot pin bore 64 to fix the pin 60 both longitudinally and rotationally relative to the swivel first member 40. As can be seen in FIGS. 1 and 2, the swivel first member 40 will pivot perpendicularly relative to the axis of the header tube 12. In a preferred embodiment, the upper pivot pin 60 has a diameter of about ⅞" (about 2.2 cm), and the clamp lug openings 34 have a diameter of about 1⅛" (about 2.9 cm). The through-hole 46 can have a diameter of about 1" (about 2.5 cm).

Bushings 62 (FIGS. 1 and 2) are received in the openings 34 of the clamp lugs 32. The bushings include a cylindrical body with an outer diameter sized to be snuggly received in the lug opening 34, and an end flange which prevents the bushings from being inserted too far into the lug opening 34. The bushing bodies have an inner diameter sized to snuggly, yet rotationally, receive the pivot pin 60 which extends through the swivel first member body through-hole 46. The bushings 62 are made from a self-lubricating material, such as an oil-impregnated bronze, to facilitate rotation of the pivot pin 60 in the bushing.

Figure 12:
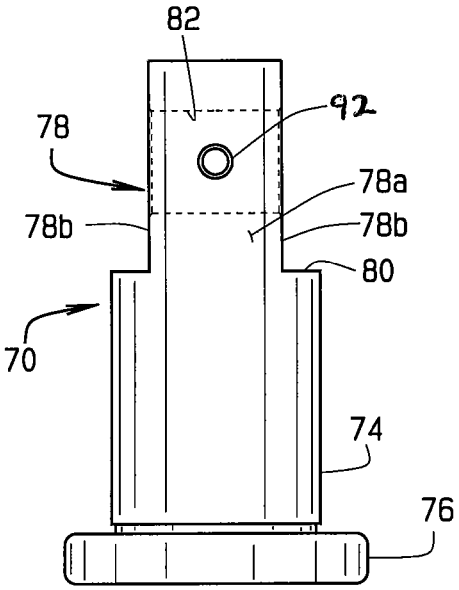
FIG. 12 is a side elevational view of a swivel second member of the swivel assembly which is suspended from the swivel first member to pivot with respect to the swivel first member.
Figure 13:
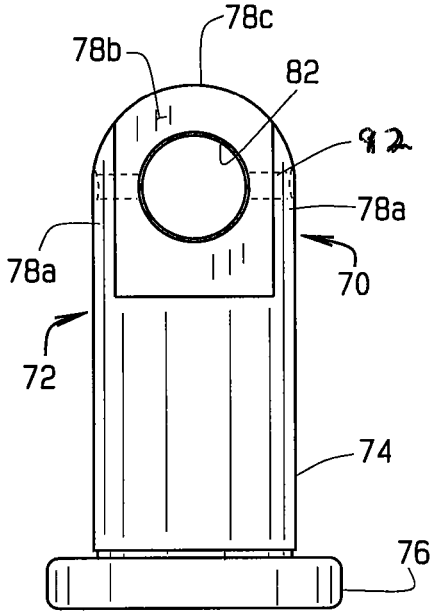
FIG. 13 is a front elevational view of the swivel second member.

An inner housing or swivel second member 70 (FIGS. 12-13) is pivotally suspended from the swivel first member to pivot in a direction generally parallel to the axis of the header tube 12. The swivel second member comprises a body 72 having a generally cylindrical lower portion 74 with a circumferential flange 76 extending radially outwardly from the body 72 at the bottom of the lower portion 74. An upper portion 78 extends upwardly from the lower portion 74. The upper portion 78 has curved front and back surfaces 78*a*, which match the curvature of the bottom portion, and flat side surfaces 78*b*. The front and back surfaces 78*a* transition smoothly to a curved upper surface 78*c*. The side-to-side width of the upper portion 78 is less than the diameter of the lower portion 74, and thus a shoulder 80 is formed between the upper and lower portions 74, 78 of the swivel second member 70.

Figure 3:
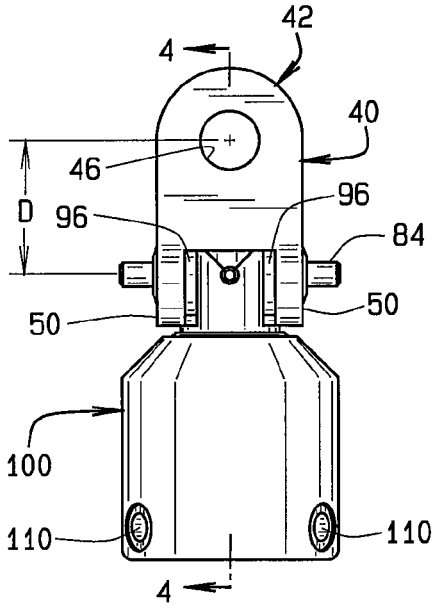
FIG. 3 is a side elevational view of the swivel assembly.
Figure 4:
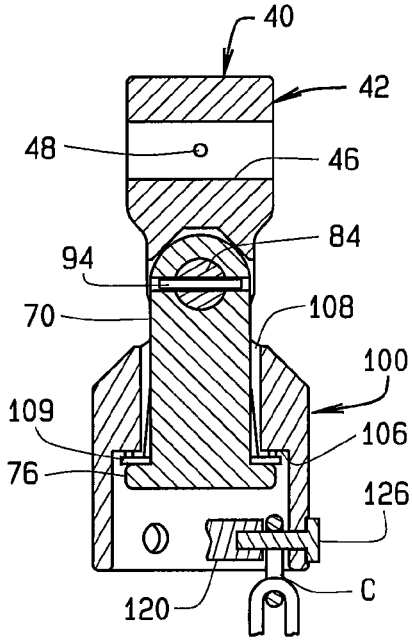
FIG. 4 is a cross-sectional view of the swivel assembly, showing a chain mounted in the swivel assembly.
Figure 5:
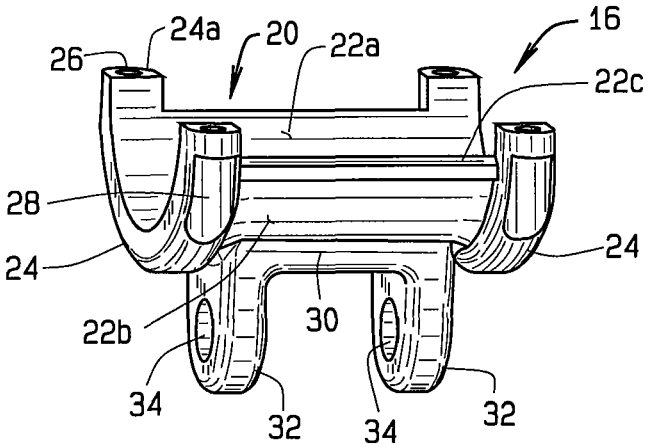
FIG. 5 is a perspective view of a clamp bottom portion of a mounting clamp used to mount the swivel assembly to the header tube.
Figure 6:
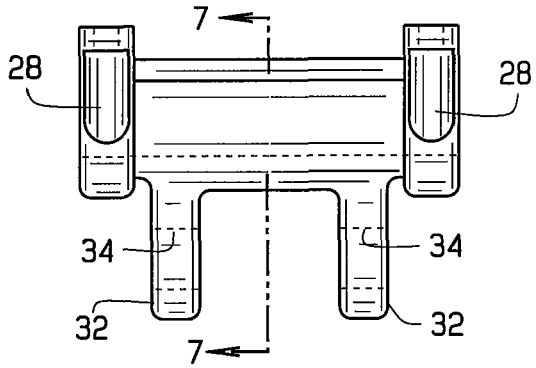
FIG. 6 is a side elevational view of the clamp bottom portion.
Figure 7:
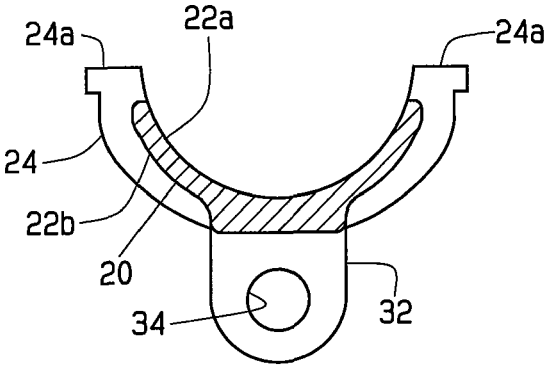
FIG. 7 is a cross-sectional view of the clamp bottom portion taken along line 7-7 of FIG. 6.
Figure 8:
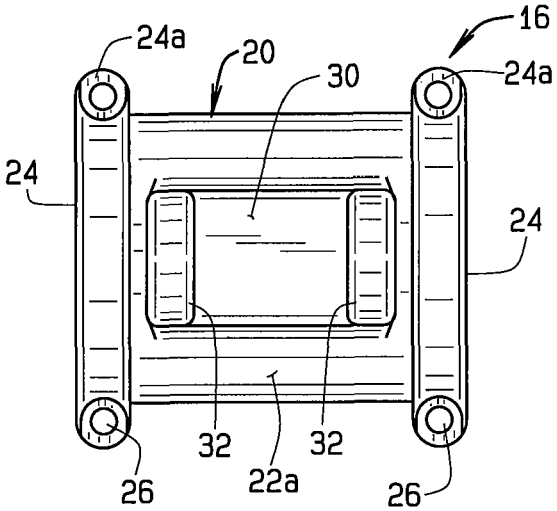
FIG. 8 is a bottom plan view of the clamp bottom portion.
Figure 18:
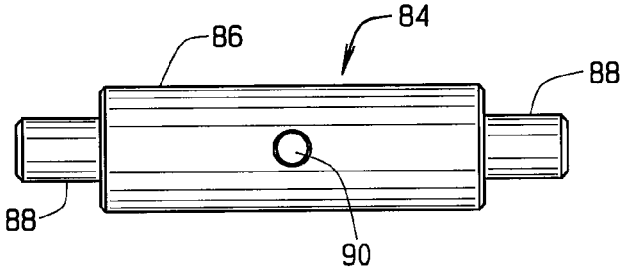
FIG. 18 is a side elevational view of a bottom swivel pin.

A through-hole 82 extends through the body upper portion 78 exiting at the sides 78*b*. The through-hole 82 receives a lower pivot pin 84 (FIGS. 3, 4 and 18) which extends through the through-hole 82 of the swivel second member and the openings 52 of the ears 50 of the swivel first member 40. The lower pivot pin 84, as seen in FIG. 3, extends beyond the sides of the ears 50. As seen in FIG. 18, the lower pivot pin 84 has a central portion 86 and opposed end portions 88. The end portions 88 are threaded. The central portion 86 has a length approximately equal to the distance between outer surfaces of the ears 50 of the swivel first member. Illustratively, the central portion has a diameter of about ¾" (about 4.4 cm) and a length of about 2.3" (about 5.8 cm). The swivel second member through-hole 82 has a diameter slightly larger than the diameter of the lower swivel pin. To maintain the lower swivel pin 84 in place, both longitudinally and rotationally, relative to the swivel second member 70, the lower pivot pin 84 includes a pin hole 90 which aligns with a pin hole 92 extending through the swivel second member upper portion. A retaining pin 94 (FIG. 4) passes through the aligned pin holes to maintain the lower pivot pin in place relative to the swivel second member. As with the pivot connection between the swivel first member and the clamp 14, bushings 96 (FIG. 3) are received in the openings 52 of the swivel first member ears 50. The bushings 96, which are generally similar in shape to the bushings 62, are sized to receive the central portion 86 of the lower pivot pin 84. Like the bushings 62, the bushings 96 are made from a self-lubricating material, such as an oil-impregnated bronze, to facilitate rotation of the pivot pin 84 in the bushings 96.

The side-to-side width of the upper portion 78 of the swivel second member 70 is sized to fit between the ears 50 of the swivel first member 40 and the flanges of the bushings 96. Illustratively, the upper portion 78 can have a side-to-side width of about 0.9" (about 2.3 cm) to about 1" (about 1.5 cm), the ears 50 of the swivel first part 40 can be separated by a distance of about 1.3" (about 3.3 cm); and the flange of the bushing can have a width of about 0.15" (about 0.4 cm).

Figure 14:
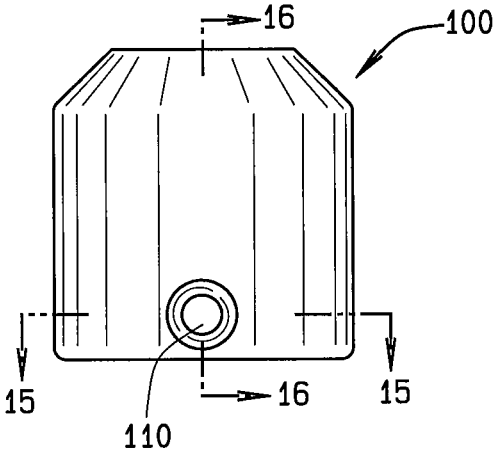
FIG. 14 is an elevational view of a swivel third member of the swivel assembly.
Figure 15:
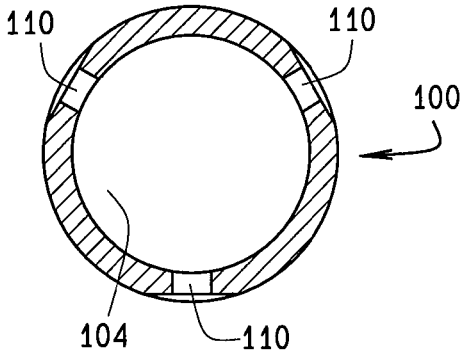
FIGS. 15 and 16 are cross-sectional view of the swivel third member taken along lines 15-15 and 16-16, respectively, of FIG. 14.
Figure 16:
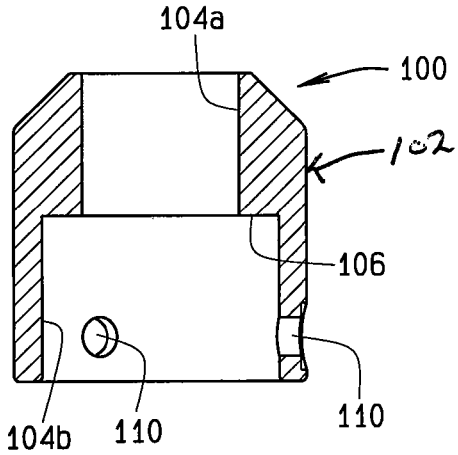

A housing or swivel third member 100 (FIGS. 14-16) includes a body 102 having a bore 104 extending vertically there through. The bore 104 has an upper portion 104*a* and a lower portion 104*b*. The bore upper portion has a diameter smaller than the bore lower portion; and a shoulder 106 is formed at the junction of the two bore portions 104*a,b*. The bore upper portion 104*a* has a diameter which is sized to receive the swivel second portion 70, but which is smaller than the flange 76 of the swivel second portion. Hence, the shoulder 106 effectively sits on the flange 76 of the swivel second portion; and the swivel second portion 70 thus supports the housing 100 in the swivel assembly 10. The inner surface of the bore upper portion 104*a* and the outer surface of the swivel second portion 70 are both circular. Thus, the swivel third portion 100 can rotate 3600 about the swivel second portion 70. Preferably, a bushing 108 and a thrust washer 109 (FIG. 4) are positioned between the swivel third portion 100 and the swivel second portion 70. Like the bushings 62 and 96, the bushing 108 is made from a self-lubricating material, such as an oil-impregnated bronze. The thrust washer 109 can be made from a self-lubricating thermoplastic. The self-lubricating material from which the bushing 108 and the thrust washer 109 are made facilitate rotation of the swivel third member 100 about the swivel second member 70. Three holes 110 are formed in the wall of the swivel third member 100 near the bottom of thereof. The openings, which are spaced equally around the swivel third member, open into the bore lower portion 104*b*.

Figure 19:
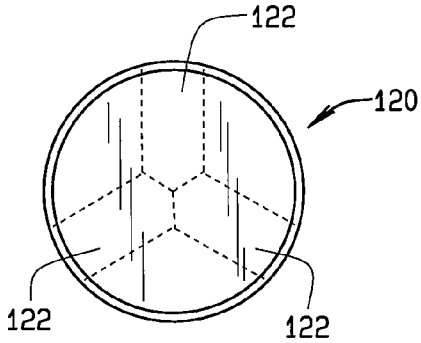
FIG. 19 is a top plan view of a chain mounting disc of the swivel assembly, with bolt holes shown in phantom.

A mounting disc 120 (FIG. 19) is received in the bore lower portion 104*b* of the swivel third member 100. The mounting disc has three threaded openings 122 spaced equally around the disc 120 and extending radially inwardly from a side surface of the disc. The openings 122 can be aligned with the holes 110 in the swivel third member 100. The disc has a diameter that is smaller than the inner diameter of the lower portion 104*b* of the swivel third potion bore 104. The difference in size between the inner diameter of the bore lower portion 104*b* and the disc 120 is sufficient to receive a link of a chain C between the disc 120 and the inner surface of the swivel third portion. For example, the disc can have a diameter of about 1½" (about 3.8 cm) and the bore lower portion 104*b* can have an inner diameter of about 2⅝" (about 6.7 cm). Bolts 126 (FIGS. 2 and 4) then pass through the holes 110 in the swivel third member 100, through an upper link of the chain C and into the threaded holes 122 of the mounting disc 120. As can be appreciated, three chains are mounted to the swivel assembly 10 to support a tire (not shown) of a tire swing.

Figure 20:
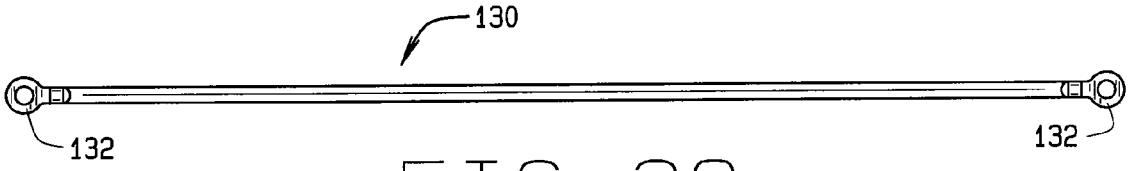
FIG. 20 is a plan view of a tether of the swivel assembly.

Lastly, the swivel assembly 10 includes a tether 130. The tether 130 (FIG. 20) has eyelets 132 at its opposed ends. The eyelets are sized to be received over the threaded ends 88 of the lower pivot pin 84. Lock nuts 134 (FIG. 1) can be threaded onto the threaded ends 88 of the lower pivot pin 84 to secure the tether to the opposite ends of the pivot pin. As seen in FIG. 1, the tether 130 has a length that allows the tether to extend from one end of the lower pivot pin, over the top of the header tube 12, and to the opposite end of the lower pivot pin. The tether can, for example, have a length of about 30" (about 76 cm). Of course, this length depends on the size of the header tube 12, and the distance between the lower pivot pin and the header tube 12. The tether is preferably a stainless steel cable that is coated, for example, with vinyl. The tether is sized to have a working load limit that will support the weight of the tire swing, the swivel assembly 10, and anyone on the tire swing should the swivel assembly catastrophically fail to prevent the tire swing from falling to the ground. Although the tether is preferably made from a vinyl-coated stainless steel cable, the tether could be made from other materials which can withstand the elements to which it will be exposed and can support the necessary weight in case of failure.

As can be appreciated, the swivel assembly 10 allows for a tire swing to be suspended from the header tube 12 and to swing parallel to and perpendicular to the header tube 12. The swivel assembly will also allow the tire swing to rotate 360° about an axis of the swivel assembly. Importantly, the sloped surfaces 54*b* of the bottom surface 44*d* of the swivel first member body 42 acts as a positive stop to limit the degree with which the swivel second member can pivot with respect to the swivel first member. Most prior swivel assemblies, allow the swivel second member to pivot nearly 90° in one direction for a path of travel of nearly 180°. However, in the swivel assembly 10, as the swivel second member 70 pivots relative to the swivel first member 40, the swivel second member 70 will engage the sloped surface 54*b* when the axis of the swivel second member 70 defines an angle of about 50° with the axis of the swivel first member 40. Hence, the swivel second member is limited to a path of travel of about 100°. By limiting the path of travel of the swivel second member, a potential pinch point is substantially reduced.

The swivel assembly 10 also has a center-to-center distance between the upper and lower pivot pins 60, 84 that is substantially less than in currently available tire swing swivel assemblies. Whereas a pin-to-pin distance of about 3.5"-4" (about 8.9-10 cm) is common in currently available tire swing assemblies, the swivel assembly 10 has a center-to-center distance D (FIG. 3) between the upper and lower pivot pins of less than about 3" (less than about 7.6 cm) and preferably about 2" (about 5 cm). When the swivel second member 70 pivots relative to the swivel first member 40, torque loads are produced that generate stresses in the upper pivot pin 60, the bushings 62 and lugs 32 of the clamp bottom portion 16. In the swivel assembly 10, because the pin-to-pin distance is reduced, the torque loads are reduced, thereby substantially reducing the stresses that are induced in the swivel assembly. This leads to an increased life of the swivel assembly. In fact, in life-time testing, the swivel assembly 10 passed one million (1,000,000) cycles without failure, and it is believed that the swivel assembly 10 can last significantly longer than one million cycles. This is a longer life span than currently available swivel assemblies reach.

The stresses are further reduced by altering the relative sizes of the pins. Whereas prior swivel assemblies had upper and lower pivot pins that were both ½" (~1.3 cm), for example, the upper and lower pivot pins 60 and 84 preferably have diameters of about ⅞" (about 2.2 cm) and about ¾" (about 1.9 cm), respectively. Because higher stresses are induced in the upper pivot pin, the lower pivot pin need not be as large in diameter as the upper pivot pin.

In the swivel assembly 10, the swivel first member, second member and third member, the pivot pins, the retaining pins and the mounting disc are all made from stainless steel 304. The bushings, on the other hand, are preferably made from an oil impregnated bronze and are thus self lubricating. The bushings thus function as bearings to facilitate pivotal movement of the pivot first member relative to the clamp; pivotal movement of the pivot second member relative to the pivot first member; and rotational movement of the pivot third member relative to the pivot second member.

As various changes could be made in the above constructions without departing from the scope of the invention, it is intended that all matter contained in the above description or shown in the accompanying drawings shall be interpreted as illustrative and not in a limiting sense. For example, although the bushings 62, 96 and 108 are disclosed to be made from an oil impregnated bronze and the thrust washer 109 is disclosed to be made from a self-lubricating thermoplastic, these components can be made from other materials, as long as the materials would facilitate rotating of the swivel members 40, 70, and 100 relative to each other. In fact, the bushings 62, 96 and/or 108 could even be replaced with roller-element bearing assemblies. The swivel members 40, 70 and 100 are disclosed to be made from 304 stainless steel, but could be made from other materials which will withstand exposure to weather. In a variation of the swivel first member, the swivel first member could be provided with pins which extend outwardly from the surfaces 44*a* of the swivel first member body 42. These would then be received in the openings 34 of the clamp lugs 32. This would eliminate the upper pivot pin 60 as a separate piece, but would require that the clamp member 20 be formed in two pieces. Alternatively, the noted pins could extend inwardly from the clamp ears (thereby eliminated the clamp ear holes 34) to be received in bores in the sides of the swivel first member. In a similar vein, the lower pivot pin 84 could be replaced by pins which extend inwardly from the lugs of the first swivel member to be received in the through-hole 82 of the swivel second member 70. This would likely require that the swivel first member be comprised of two pieces. These examples are merely illustrative.

The invention claimed is:

1. A tire swing swivel assembly comprising:

a clamp assembly adapted to be secured to a header tube; the clamp assembly comprising a bottom member; and a pair of spaced apart lugs extending downwardly from the bottom member; the lugs defining aligned openings;

a swivel first member comprising a body having a front and back surfaces; side surfaces, a bottom surface and a pair of spaced-apart lugs extending downwardly from the bottom surface; said body having a side-to-side width sized to be received between said clamp assembly lugs; a through-hole extending through said body, and aligned openings in said lugs;

an upper pivot pin which extends through said through-hole of said swivel first member and the openings of said clamp lugs to pivotally connect said swivel first member to said clamp assembly; whereby said swivel first member can pivot in a first direction relative to an axis of the header tube;

a swivel second member comprising a body having an upper portion and a lower portion, a flange extending outwardly proximate a bottom of said lower portion; and a through-hole extending through said upper, portion; at least said lower portion being generally circular in cross-section;

a lower pivot pin which extends through said through-hole of said swivel second member and the openings of said lugs of said swivel first member to pivotally connect said swivel second member to said swivel first member; whereby said swivel second member can pivot in a second direction relative to the axis of the header tube; said second direction being different from said first direction; and a tether; said tether having opposite ends secured to opposite sides of said lower pivot pin; said tether being sized to extend over said header tube and being sufficiently strong to support a tire swing, the swivel assembly, and anyone on the tire swing should the swivel assembly catastrophically fail.

2. A tire swing swivel assembly comprising:

a clamp assembly adapted to be secured to a header tube; the clamp assembly comprising a bottom member; and a pair of spaced apart lugs extending downwardly from the bottom member; the lugs defining aligned openings;

a swivel first member comprising a body having a front and back surfaces; side surfaces, a bottom surface and a pair of spaced-apart lugs extending downwardly from the bottom surface; said body having a side-to-side width sized to be received between said clamp assembly lugs; a through-hole extending through said body, and aligned openings in said lugs;

an upper pivot pin which extends through said through-hole of said swivel first member and the openings of said clamp lugs to pivotally connect said swivel first member to said clamp assembly; whereby said swivel first member can pivot in a first direction relative to an axis of the header tube;

a swivel second member comprising a body having an upper portion and a lower portion, a flange extending outwardly proximate a bottom of said lower portion; and a through-hole extending through said upper portion; at least said lower portion being generally circular in cross-section; and a lower pivot pin which extends through said through-hole of said swivel second member and the openings of said lugs of said swivel first member to pivotally connect said swivel second member to said swivel first member; whereby said swivel second member can pivot in a second direction relative to the axis of the header tube bar; said second direction being different from said first direction;

wherein the bottom surface of said swivel first member comprises a central surface which is generally perpendicular to an axis of the swivel first member and sloped side surfaces; said sloped side surfaces defining a positive stop to prevent the swivel second member from pivoting beyond a desired angle relative to an axis of the swivel first member.

3. The swivel assembly of claim 2 wherein said stop prevents said swivel second member from pivoting beyond an angle of about 50° relative to said axis of the swivel first member.

4. The swivel assembly of claim 3 wherein said sloped surfaces of the swivel first member bottom surface define an angle of about 45° relative to the axis of the swivel first member.

5. A tire swing swivel assembly comprising:

a swivel first member comprising a body having front and back surfaces, side surfaces, and a bottom surface; said body including means for pivotably suspending said swivel first member from an overhead bar; said means defining a first pivot axis for said tire swing swivel assembly; said swivel first member further including a pair of spaced-apart lugs extending downwardly from said body; said spaced-apart lugs being spaced apart along a line perpendicular to the first pivot axis;

a swivel second member comprising a body having an upper portion, a lower portion, and an outwardly extending flange; said upper portion being sized to be received between said spaced; apart lugs of said swivel first member and being adapted to be pivotally mounted to said swivel first member between said lugs to pivot relative to said swivel first member; said second pivot axis being generally perpendicular to said first pivot axis; and a swivel third member received about said swivel second member; said swivel third member defining a shoulder sized and shaped to sit upon said flange of said swivel second member, such that said swivel third member can rotate about said swivel second member; said swivel second member defining an axis of rotation for said swivel third member which is generally perpendicular to both said first and second pivot axes.

6. The tire swing swivel assembly of claim 5 wherein said first and second pivot axes are generally horizontal.

7. The tire swing swivel assembly of claim 5 wherein said means for pivotably suspending said swivel first member comprises opposed openings in opposite sides of said body of said swivel first member and a pin member which extends into each said opening.

8. The tire swing swivel assembly of claim 7 wherein said opening extends through said body to open on both sides of said body; said pin being an elongate rod member which extends through said body of said swivel first member.

9. The swivel assembly of claim 5 wherein the bottom surface of said swivel first member comprises sloped side surfaces; said sloped side surfaces defining a positive stop to prevent the swivel second member from pivoting beyond a desired angle relative to an axis of the swivel first member.

10. A tire swing swivel assembly comprising:

a swivel first member comprising a body having a front and back surfaces, side surfaces, and a bottom surface; said body being pivotally connectable to a mount, whereby said swivel first member can pivot in a first direction about a first pivot axis;

a swivel second member comprising a body having an upper portion, a lower portion, and an outwardly extending flange; said upper portion being adapted to be pivotally mounted to said swivel first member to pivot relative to said swivel first member in a second direction about a second pivot axis; said first direction being different from said second direction; and a swivel third member received about said swivel second member; said swivel third member defining a chamber having an inner, generally cylindrical surface and an inner shoulder; said inner shoulder extending inwardly from said inner surface and being sized and shaped to sit upon said flange of said swivel second member, such that said swivel third member can rotate about said swivel second member; said swivel second member defining an axis of rotation for said swivel third member which generally perpendicular to both said first and second pivot axes.

11. The tire swing swivel assembly of claim 10 wherein said upper and lower pivot pins have a center-to-center spacing of less than about 3".

12. The tire swing swivel assembly of claim 10 wherein said upper and lower pivot pins have a center-to-center spacing of about 2".

13. The tire swing swivel assembly of claim 10 wherein said lower pivot pin has a diameter that is less than a diameter of said upper pivot pin.

14. The tire swing swivel assembly of claim 10 wherein said first direction is either parallel to or perpendicular to an axis of said header bar.

15. The tire swing swivel assembly of claim 14 wherein said second direction is generally normal to said first direction.

16. The tire swing swivel assembly of claim 10 wherein said swivel first member includes a pair of spaced-apart lugs extending downwardly from the bottom surface of said body; said swivel second member upper portion being sized to be received between said spaced apart lugs of said swivel first member and adapted to be pivotally mounted between said lugs.

* * * * *

UNITED STATES PATENT AND TRADEMARK OFFICE

CERTIFICATE OF CORRECTION

PATENT NO. : 8,376,294 B2
APPLICATION NO. : 12/497062
DATED : February 19, 2013
INVENTOR(S) : J. Stephen Steury and Steven B. Adkins It is certified that error appears in the above-identified patent and that said Letters Patent is hereby corrected as shown below:

In the Specifications:

Col. 6, Line 17
Replace "3600"
with -- 360° --

In the Claims:

Col. 8, Line 51
Replace "upper, portion"
with -- upper portion --

Signed and Sealed this
Twenty-first Day of May, 2013

Teresa Stanek Rea
*Acting Director of the United States Patent and Trademark Office*